US008869976B1

(12) United States Patent
Smith

(10) Patent No.: US 8,869,976 B1
(45) Date of Patent: Oct. 28, 2014

(54) STORAGE CASE FOR WHISTLE

(71) Applicant: Thomas H. Smith, Merrillville, IN (US)

(72) Inventor: Thomas H. Smith, Merrillville, IN (US)

( * ) Notice: Subject to any disclaimer, the term of this patent is extended or adjusted under 35 U.S.C. 154(b) by 0 days.

(21) Appl. No.: 14/095,501

(22) Filed: Dec. 3, 2013

(51) Int. Cl.
*A45C 15/00* (2006.01)
*B65D 69/00* (2006.01)
*B65D 77/24* (2006.01)

(52) U.S. Cl.
CPC ..... *B65D 77/24* (2013.01)
USPC ..... 206/38; 206/494; 206/581

(58) Field of Classification Search
USPC ..... 206/37, 38, 223, 235, 494, 581, 822; D10/119.3; 116/137 R; 446/204
See application file for complete search history.

(56) References Cited

U.S. PATENT DOCUMENTS 2,877,598 A * 3/1959 Seron ..... 446/204
3,760,459 A 9/1973 Miles
4,449,474 A * 5/1984 Mariol ..... 206/38
5,002,006 A * 3/1991 Ehrenreich ..... 116/137 R
6,125,998 A * 10/2000 Batista ..... 206/38
7,686,161 B2 * 3/2010 Simmons ..... 206/494
D613,054 S 4/2010 Morszeck
7,850,039 B1 * 12/2010 Tsengas ..... 206/494
8,272,507 B1 9/2012 Crump et al.
2002/0043473 A1 * 4/2002 Lee et al. ..... 206/217
2004/0195135 A1 10/2004 Seamon
2007/0142811 A1 * 6/2007 Lais ..... 604/385.06
2012/0255881 A1 * 10/2012 Kuroda et al. ..... 206/223

OTHER PUBLICATIONS

BG-W1 Accessory/Whistle Bag. https://officiallysports.com/index.cfm?id=620&page=detail Feb. 5, 2013 (1 page).
CSI White Whistle Tip Guard for Metal Whistles. http://www.amazon.com/CSI-White-Whistle-Guard-Whistles/dp/B0000BY92P/ref=sr_1_15?s=sporting-goods&ie=UTF8&qid=1360041955&sr=1-15&keywords=sport+whistle Published Apr. 22, 2010. ( 1 page).

* cited by examiner

*Primary Examiner* — Luan K Bui
(74) *Attorney, Agent, or Firm* — Robert C. Montgomery; Montgomery Patent & Design

(57) ABSTRACT

A storage case substantially in a shape of a hand-held whistle comprises two (2) halves hingedly connected to each other at a top portion. The case is provided with a storage unit located at a side surface of the case configured to hold a plurality of moistened wipes.

12 Claims, 3 Drawing Sheets

STORAGE CASE FOR WHISTLE

RELATED APPLICATIONS

There are no current related applications.

FIELD OF THE INVENTION

The presently disclosed subject matter is directed to a storage case particularly suited to hold a whistle.

BACKGROUND OF THE INVENTION

When coaching, directing traffic, or merely commanding someone's respect and attention the use of a whistle accomplishes wonders. The whistle produces a distinct sound that makes even the most un-attentivealert. A problem with the use of a whistle is the transportation and caring of it. Whistles are small, and so they tend to fall out of our sight and get lost. Furthermore, the use of a whistle occurs in situations that typically require rigorous activity, which is usually outdoors. A misplaced whistle can pose a precarious situation for a user, especially considering the fact that the whistle must be placed in one's mouth for use. There is a need to assist whistle users in keeping the whistle in a contained and secure location within a case. There is also a need to protect the whistle in situations where it does fall out of sight.

Also, during the use of a whistle, it is sometimes necessary to put the whistle down and pick it back up. This is often the case in between uses of the whistle. The development of present invention also provides a hygienic method of storing the whistle when not in use. The addition of a separate package of sanitary wipes that is removably placed on the invention also contributes greatly to maintaining proper hygiene. A user can conveniently grasp an individual wipe from the package that is place on the invention and not have to search for them.

The device comprises a casing, having two (2) hinged attach members forming the case. The case is provided with a means to lock the members in a closed position. A rear portion of the case is provided with an aperture to facilitate the use of a lanyard. The invention is further equipped with a wipe packet that houses sanitation wipes. This packet is securely placed within the case for use at a user's discretion.

Prior art in this field consists of accessory cases and whistle covers. Prior art fails to provide a case for a whistle that can protect the whistle, act as a carrying case for the whistle, and hold sanitary wipes for the whistle. It is an objective of this invention to provide a case for a whistle that covers the whistle and keeps the whistle in a clean state while not in use. It is a further object of this invention to provide a whistle case with a hinged door for easy access to the whistle. It is a further object of this invention to enable the case to facilitate the use of a lanyard with the whistle case. It is a further object of this invention to provide a wipe pack that may be enclosed in the case along with the whistle to assist a user in maintaining the whistle in a clean and sterilized state.

SUMMARY OF THE INVENTION

The invention comprises a case that is molded to form a first shell hingedly attached to a second shell. The first shell and the second shell, when in a closed position, form a general shape of a common mouth whistle. The case is further provided with an aperture to facilitate the use of a lanyard. A clasp and bead securement construction is disposed on a side surface of the case to enable securement of the two (2) shells in a closed position.

The invention is further equipped with a packet having a sterilizing sanitary wipe within. In an alternative embodiment, the packet is provided with a pull cord embedded between the sealed edges of the packet to assist a user in tearing open the packet when attempting to employ the wipe within. The wipe packet fits into an interior space of a shell while a whistle is also enclosed inside the case. The wipe packet and the whistle is held within the case and transported to various sporting and other events until the time arises to use the whistle. At the user's discretion, the wipe packet can be used to clean and disinfect the whistle prior to use.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
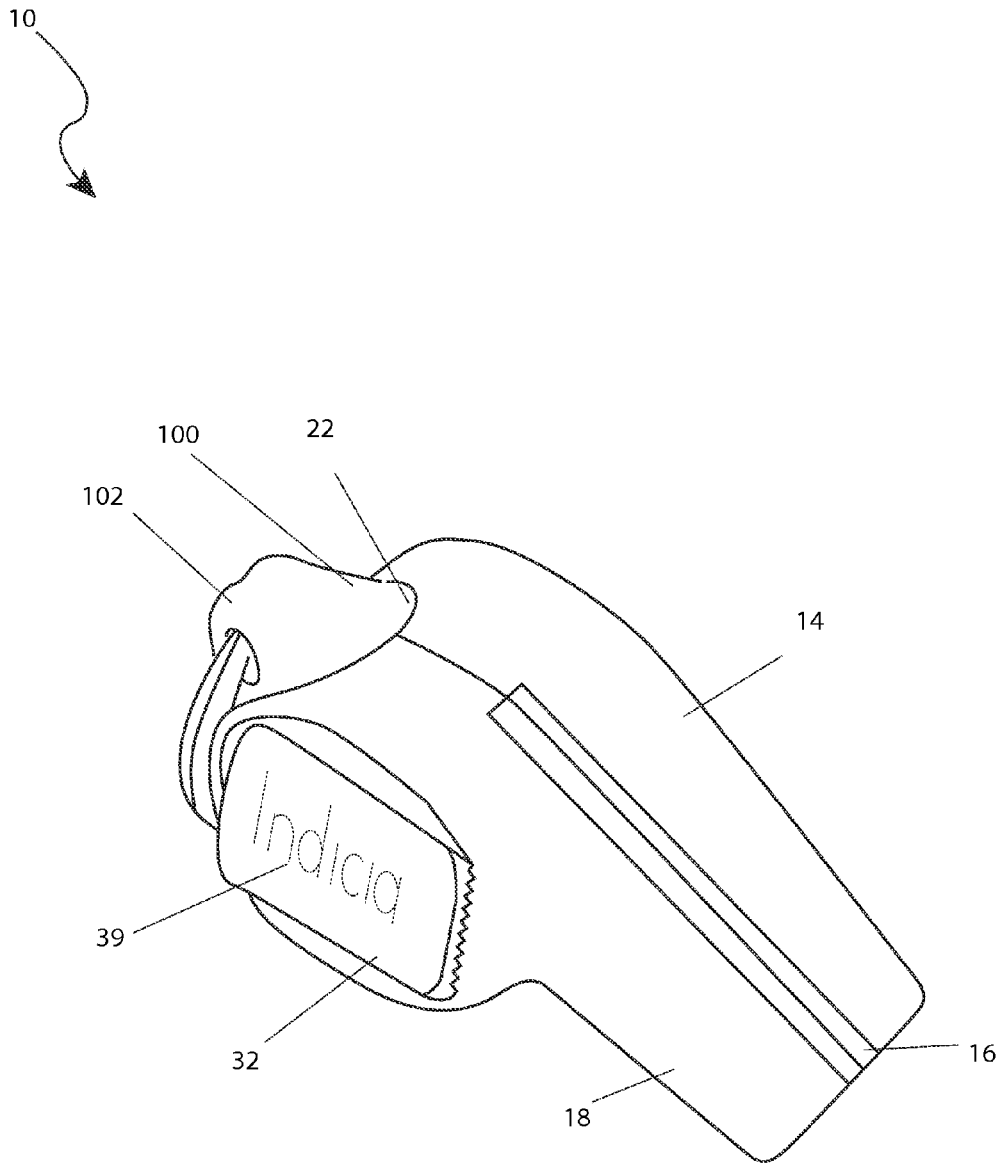
FIG. 1 is an isometric view of a storage case for a whistle 10 in accordance with the preferred embodiment of the present invention.

10 storage case for a whistle
14 first shell
16 hinge
18 second shell
21 interior
22 shell aperture
24 clasp
25 clasp aperture
28 clasp bead
31 wipe
32 wipe packet
33 pull string
34 mastic layer
35 packet seam
36 protective cover
39 packet indicia
100 whistle
101 threading eye

DETAILED DESCRIPTION OF THE PREFERRED EMBODIMENT

The best mode for carrying out the invention is presented in terms of its preferred embodiment, herein is depicted in FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a storage case (herein referred to as the "case") 10, which provides a means to store a pea whistle 100, preferably of the style of "Acme Thunderer", in a biostatically controlled environment when not in use and sanitize it prior to the next use. This case 10 may also accommodate a Fox 40® pealess whistle in some embodiments.

Figure 2:
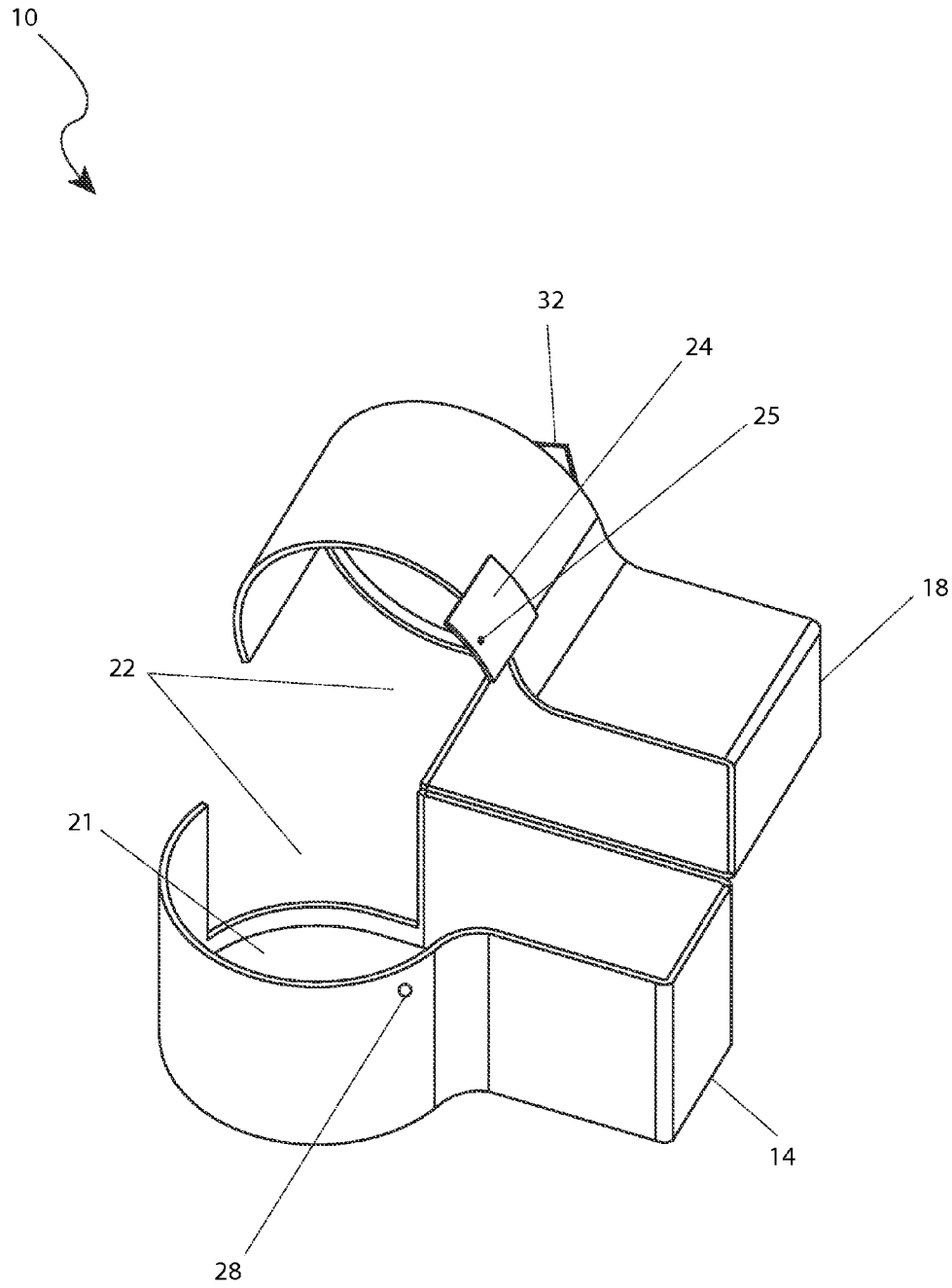
FIG. 2 is an isometric view of the storage case for a whistle 10 opened to reveal the interior 21 in accordance with the preferred embodiment of the present invention.

Referring now to FIG. 1, an isometric view of the case 10, and FIG. 2, an isometric view of an open case 10, according to the preferred embodiment of the present invention, are disclosed. The case 10 is comprised preferably of a molded thermoplastic material and as such may be presented in a wide variety of colors and surface finish textures. However, it is understood that other materials may be utilized without limiting the scope of the invention. The case 10 is comprised of a first shell 14 attached by means of a hinge 16 to a second shell 18. The hinge 16 is preferably comprised of a strip of thermoplastic sheet goods with a groove medially impressed therein to ease the flexure of the material, and bonded to each of the first shell 14 and the second shell 18, either by heat or chemically. The first shell 14 and the second shell 18 in the illustrated closed position take the general shape of a common mouth whistle 100 with a shell aperture 22 provided in a rear portion for clearance of a lanyard or threading eye 101 on the whistle 100. The interior 21 of the case 10 is of sufficient size to accommodate a whistle 100.

Disposed upon a rounded portion of the front of the second shell 18 is a clasp 24 provided with a clasp aperture 25. The clasp 24 is preferably comprised of a thermoplastic material and bonded to the second shell 18. The clasp aperture 25 is provided for the insertion of a clasp bead 28. The clasp bead 28 is comprised of a preferably cylindrical post with a spherical end either molded with, or bonded to a rounded portion of the front of the first shell 14. The clasp aperture 25 is approximately the size of the spherical end of the clasp bead 28 such that said clasp bead 28 is retained in said clasp aperture 25 to hold the case 10 in a closed position.

Figure 4:
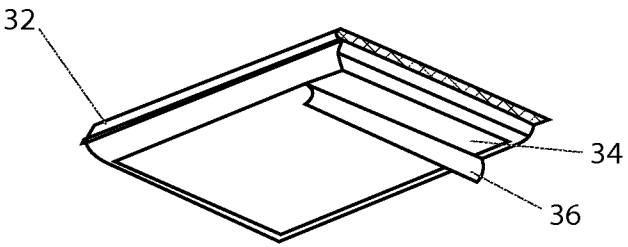
Figure 3:
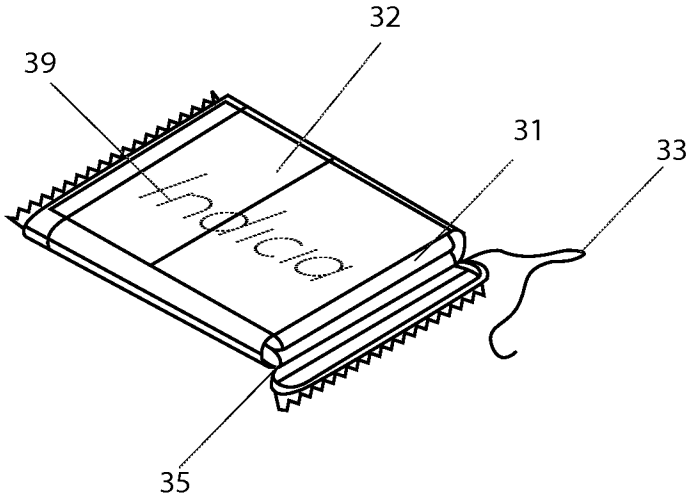
FIG. 3 is a perspective view of the wipe packet 32 opened to show a wipe 31 of the storage case for a whistle 10 in accordance with the preferred embodiment of the present invention; and, FIG. 4 is another perspective view of the wipe packet 32 of the storage case for a whistle 10 in accordance with the preferred embodiment of the present invention.

Referring now to FIGS. 3 and 4, perspective views of the wipe packet 32, according to the preferred embodiment of the present invention, are disclosed. The wipe packet 32 is comprised preferably of a thin metal foil membrane or other barrier material, bonded to an exterior paper membrane and formed into a cylinder which is then flattened and sealed around a folded wipe 31 soaked in alcohol or other disinfecting solution. In some embodiments a second end of a length of cotton or nylon pull string 33 may be embedded under the barrier layer of the wipe packet 32 and entrapped in a packet seam 35 to assist the user in opening said wipe packet 32 to access the folded wipe 31 by pulling on the exposed first end of said pull string 33. Disposed upon the majority of the outer surface on one (1) side of the wipe packet 32 is a pressure sensitive mastic layer 34 with a peel-off protective cover 36. The wipe packets 32 would be procured in this manner and, as suited a user, the peel-off protective cover 36 would be removed to expose the mastic layer 34 and said wipe packet 32 would be applied to the flat exterior side of the second shell 18. The wipe packet 32 would remain on the case 10 until such time as the wipe 31 would be required to cleanse the whistle 100.

The upper surface of the wipe packet 32 may include packet indicia 39 which may provide script or logos based upon the inventor's preference or a user's preference and may include images such as, but not limited to, instructions for use, symbols, pictures, and the like to further customize or personalize the case 10 further comprising a variety of colors and patterns.

While the illustrations presented with this preferred embodiment depict a right-handed case 10, it can be appreciated by someone skilled in the art that a case 10 with opposite handing would be within the scope of this invention.

The preferred embodiment of the present invention can be utilized by the enabled user in a simple and straightforward manner with little or no training. The method of utilizing the case 10 may be achieved by performing the following steps: acquiring a model of the case 10 having a desired style to suit the taste of the user; opening the case by disengaging the clasp bead 28 from the clasp aperture 25; inserting a whistle 100 into the case 10 as illustrated in FIG. 1; closing the case; and applying a wipe packet 32 to the second shell 18. The case 10 with a whistle 100 stored inside could be transported anywhere to suit the user. When the user determined that cleansing of the whistle 100 was required, said whistle would be removed from the case and the wipe packet 32 would be opened to access the folded wipe 31. The wipe 31 would then be unfolded and used to clean the whistle 100.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A storage case configured to store a whistle, comprising:

a first shell having a first rounded portion, a first extension portion, and a first interior;

a second shell attached to said first shell via a hinge, having a second rounded portion, a second extension portion, and a second interior;

a fastening means located at opposing facing sides of said first and second rounded portions for securing said first shell to said second shell; and, a packet removably bonded to either said first or second shell, further having a packet interior;

wherein said case is formed when said first shell is mated to said second shell;

wherein said hinge is an integral portion of said first shell and said second shell;

wherein said first interior and said second interior, when combined, is configured to store said whistle;

wherein an aperture is formed when said first rounded portion and said second rounded portion are combined, said aperture configured to permit outward extension of a portion of said whistle; and, wherein said packet interior is configured to retain at least one disinfecting wipe therein.

2. The case of claim 1, wherein said hinge is a strip having a groove medially impressed therein.

3. The case of claim 1, wherein said fastening means comprises:

a clasp having a clasp aperture disposed upon said second rounded portion of the front of the second shell; and, a clasp bead disposed on said first rounded portion;

wherein a bulbous end of said clasp bead correspondingly mates with said clasp aperture.

4. The case of claim 1, wherein said packet further comprises a generally rectangular structure.

5. The case of claim 4, wherein said packet further comprises:

a thin metal foil membrane bonded to an exterior membrane;

an adhesive located on an exterior surface of said exterior membrane; and, a protective cover bonded to said adhesive.

6. The case of claim 5, further comprising a pull string embedded under said exterior membrane entrapped in a packet seam;

wherein an end of said pull string is exposed outside said packet.

7. A storage case configured to store a whistle, comprising:

a first shell having a first rounded portion, a first extension portion, and a first interior;

a second shell attached to said first shell via a hinge, having a second rounded portion, a second extension portion, and a second interior;

a fastening means located at opposing facing sides of said first and second rounded portions for securing said first shell to said second shell; and, a packet removably bonded to either said first or second shell, further having a packet interior;

wherein said case is formed when said first shell is mated to said second shell;

wherein said hinge is bonded to said first shell and said second shell;

wherein said first interior and said second interior, when combined, is configured to store said whistle;

wherein an aperture is formed when said first rounded portion and said second rounded portion are combined, said aperture configured to permit outward extension of a portion of said whistle; and, wherein said packet interior is configured to retain at least one disinfecting wipe therein.

8. The case of claim 7, wherein said hinge is a strip having a groove medially impressed therein.

9. The case of claim 7, wherein said fastening means comprises:

a clasp having a clasp aperture disposed upon said second rounded portion of the front of the second shell; and, a clasp bead disposed on said first rounded portion;

wherein a bulbous end of said clasp bead correspondingly mates with said clasp aperture.

10. The case of claim 7, wherein said packet further comprises a generally rectangular structure.

11. The case of claim 10, wherein said packet further comprises:

a thin metal foil membrane bonded to an exterior membrane;

an adhesive located on an exterior surface of said exterior membrane; and, a protective cover bonded to said adhesive.

12. The case of claim 11, further comprising a pull string embedded under said exterior membrane entrapped in a packet seam;

wherein an end of said pull string is exposed outside said packet.

* * * * *